US009615411B2

(12) United States Patent
Kim et al.

(10) Patent No.: US 9,615,411 B2
(45) Date of Patent: Apr. 4, 2017

(54) BACKLIGHT UNIT INCLUDING A POWER TRANSMITTING WIRE

(71) Applicant: SAMSUNG DISPLAY CO., LTD., Yongin, Gyeonggi-Do (KR)

(72) Inventors: Min-Woo Kim, Hwaseong-si (KR); Sang Rock Yoon, Hwaseong-si (KR); On Sik Choi, Hwaseong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 373 days.

(21) Appl. No.: 14/166,440

(22) Filed: Jan. 28, 2014

(65) Prior Publication Data

US 2015/0022122 A1 Jan. 22, 2015

(30) Foreign Application Priority Data

Jul. 16, 2013 (KR) ..... 10-2013-0083693

(51) Int. Cl.
*H01B 7/08* (2006.01)
*H05B 33/08* (2006.01)
*H01B 13/14* (2006.01)

(52) U.S. Cl.
CPC ..... *H05B 33/0803* (2013.01); *H01B 7/0823* (2013.01); *H01B 7/0838* (2013.01); *H05B 33/086* (2013.01); *H01B 13/14* (2013.01)

(58) Field of Classification Search
CPC ... H01L 27/329; H01L 27/3246; H01L 51/50; H01L 27/32; G09F 9/30; H05B 33/26; G09G 3/20; G09G 3/30; H01B 7/0823; H01B 7/0838; H01B 13/14
USPC ..... 174/102 R–117 F, 350, 351
See application file for complete search history.

(56) References Cited

U.S. PATENT DOCUMENTS

| | | | | |
|---|---|---|---|---|
| 6,420,662 | B1 | 7/2002 | Ishikawa | |
| 7,875,826 | B2 * | 1/2011 | Miller | H05K 1/025 219/121.61 |
| 7,974,103 | B2 | 7/2011 | Lim et al. | |
| 2006/0244741 | A1 * | 11/2006 | Kimura | G02F 1/13452 345/204 |
| 2007/0212878 | A1 * | 9/2007 | Johnson | H05K 1/025 438/669 |

(Continued)

FOREIGN PATENT DOCUMENTS

| | | |
|---|---|---|
| JP | 2001-177040 | 6/2001 |
| JP | 2001-223447 | 8/2001 |

(Continued)

OTHER PUBLICATIONS

Pro-Power ("Flat Flexible Cable 0.5mm, 1mm, 1.25mm Pitch", Mar. 19, 2013).*

*Primary Examiner* — Thai Pham
*Assistant Examiner* — Borna Alaeddini
(74) *Attorney, Agent, or Firm* — F. Chau & Associates, LLC

(57) ABSTRACT

The present invention relates to a backlight unit. The backlight unit includes a light source unit, a power supply unit, and a power transmitting wire. The light source includes at least one light source. The power supply circuit is configured to supply a power voltage to the light source unit. The power transmitting wire is configured to transmit the power voltage. The power transmitting wire includes at least two circuit patterns.

17 Claims, 23 Drawing Sheets

(56) References Cited

U.S. PATENT DOCUMENTS

| | | | | |
|---|---|---|---|---|
| 2008/0029299 | A1* | 2/2008 | Hakamada | H01B 7/0861 174/351 |
| 2008/0030645 | A1 | 2/2008 | Nam et al. | |
| 2008/0236868 | A1* | 10/2008 | Koga | H01B 7/0861 174/117 F |
| 2009/0126970 | A1* | 5/2009 | Sasaki | C08J 5/18 174/110 SR |
| 2010/0044071 | A1* | 2/2010 | Murao | H01B 13/144 174/116 |
| 2010/0096167 | A1* | 4/2010 | Choi | H05K 1/0245 174/254 |
| 2011/0109407 | A1* | 5/2011 | Horie | H01P 3/006 333/238 |
| 2011/0126221 | A1* | 5/2011 | Kitayama | G11B 17/056 720/600 |
| 2011/0232938 | A1* | 9/2011 | Kodama | H01B 7/0838 174/117 F |
| 2013/0012071 | A1* | 1/2013 | Nakazura | H01R 12/79 439/630 |
| 2013/0037303 | A1* | 2/2013 | Wang | H01R 13/025 174/117 FF |
| 2013/0049730 | A1* | 2/2013 | Kato | H01L 23/642 323/355 |
| 2014/0131064 | A1* | 5/2014 | Yamada | H01B 13/14 174/117 F |

FOREIGN PATENT DOCUMENTS

| | | | | |
|---|---|---|---|---|
| JP | 4254023 | | 2/2009 | |
| JP | 2011035316 | A * | 2/2011 | H05K 1/02 |
| JP | 2011-164456 | | 8/2011 | |
| KR | 1020120076968 | | 7/2012 | |

* cited by examiner

BACKLIGHT UNIT INCLUDING A POWER TRANSMITTING WIRE

CROSS-REFERENCE TO RELATED APPLICATION

This application claims priority under 35 U.S.C. §119 to Korean Patent Application No. 10-2013-0083693, filed in the Korean Intellectual Property Office on Jul. 16, 2013, the disclosure of which is incorporated by reference herein in its entirety.

TECHNICAL FIELD

The present invention relates to a backlight unit including a power transmitting wire, and more particularly, to a backlight unit including a power transmitting wire capable of reducing electro-magnetic noise.

DISCUSSION OF THE RELATED ART

As a flat panel display device, there may be a self-emitting type display device and a light receiving type display device. The self-emitting type display device may emit a light by itself and it may include a light emitting diode (LED) display device, a field emission display (FED) device, a vacuum fluorescent display (VFD) device, and a plasma display panel (PDP) device. Since the light receiving type display device cannot emit a light by itself, it uses an additional light source. The light receiving type display device may include a liquid crystal display (LCD) device and an electrophoretic display device.

The light receiving type display device may include a display panel and a backlight unit. The display panel may display an image and the backlight unit may supply a light to the display panel. The backlight unit may include a light source unit which includes at least one light source and a light source driving unit which drives the light source unit. For example, the light source may include a cold cathode fluorescent lamp (CCFL), a flat fluorescent lamp (FFL), a light emitting diode (LED), or the like. Recently, the LED may be used as the light source due to its low power consumption and low heating value.

The light source unit using the LED may include at least one LED string in which a plurality of LEDs is connected to each other in series. Each of the LED strings may emit a light having a luminance that depends on a driving current determined by a difference in voltage between an anode terminal and a cathode terminal of the LED. A power supply circuit may supply a power to a LED string through an anode. The power supply circuit may include a DC-DC conversion unit. The DC-DC conversion unit may be a boost converter which converts a lower level of a DC input voltage into a higher level of a DC driving voltage. The DC-DC conversion unit may include electric elements such as an inductor, a diode, a switching element, and a capacitor. The power generated from the power supply circuit may be transmitted to the light source unit through a power transmitting wire.

SUMMARY

An exemplary embodiment of the present invention provides a backlight unit. The backlight unit includes a light source unit, a power supply circuit, and a power transmitting wire. The light source unit includes at least one light source. The power supply circuit is configured to supply a power voltage to the light source unit. The power transmitting wire is configured to transmit the power voltage. The power transmitting wire includes at least two circuit patterns.

A width of each of the at least two circuit patterns may range from about 0.2 mm to about 0.35 mm.

A resistance of the power transmitting wire may be equal to or more than about 1 ohm.

The backlight unit may further include a flexible circuit layer on which the power transmitting wire is formed.

A portion of the flexible circuit layer may be a single layer.

The backlight unit may further include a capacitor formed by the power transmitting wire and a ground voltage terminal.

The ground voltage terminal may be connected with a chassis which stores the backlight unit.

Each of the at least circuit patterns may include a plurality of unit circuit patterns which is connected in a row. Each of the plurality of unit circuit patterns may include an extension and a pair of connection parts disposed at both sides of the extension. At least one of the pair of the connection parts may have a width smaller than a width of the extension.

The power supply circuit may include an inductor connected to an input voltage terminal and a switching element connected to the inductor. The switching element may be turned on and off according to a gate control signal.

The backlight unit may further include a feedback line which is formed on the flexible circuit layer and transmits a feedback voltage from the light source unit.

An exemplary embodiment of the present invention provides a backlight unit. The backlight unit includes a light source unit, a power supply unit, and a power transmitting wire. The light source unit includes at least one light source. The power supply circuit is configured to supply a power voltage to the light source unit. The power transmitting wire is configured to transmit the power voltage. The power transmitting wire includes at least two circuit patterns. Each of the at least two circuit patterns includes a plurality of unit circuit patterns which is connected in a row.

An exemplary embodiment of the present invention provides a backlight unit. The backlight unit includes a light source unit, a power supply unit, and a power transmitting wire. The light source unit includes at least one light source. The power supply circuit is configured to supply a power voltage to the light source unit. The power transmitting wire is configured to transmit the power voltage. The power transmitting wire includes at least two circuit patterns.

The power transmitting wire includes a first circuit pattern, a second circuit pattern, and a third circuit pattern.

The first circuit pattern includes a first extension having a first connection at a first side and a second connection at a second side.

The second circuit pattern includes a second extension having a third connection at a third side and a fourth connection at a fourth side.

The third circuit pattern includes a third extension and a fourth extension connected through a fifth connection.

DETAILED DESCRIPTION OF THE EMBODIMENTS

Figure 1:
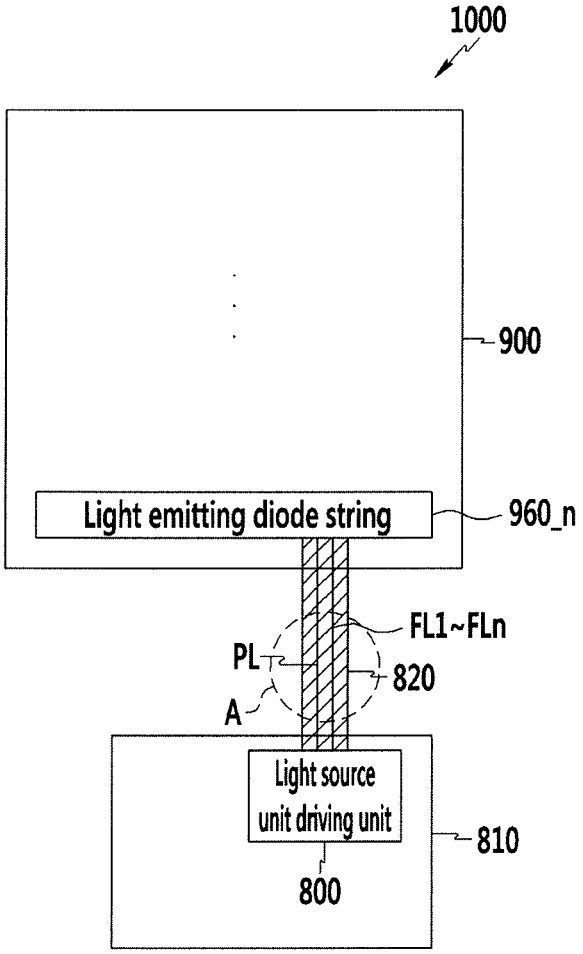
FIGS. 1 and 2 are block diagrams of a backlight unit according to an exemplary embodiment of the present invention.

The present invention will be described more fully hereinafter with reference to the accompanying drawings, in which exemplary embodiments of the invention are shown. However, the described embodiments may be modified in various forms and should not be contruded as limited to the embodiments disclosed herein.

Like reference numerals designate like elements throughout the specification. It will be understood that when an element such as a layer, film, region, or substrate is referred to as being "on" another element, it can be directly on the other element or intervening elements may also be present. Hereinafter, a power transmitting wire and a backlight unit including the same according to an exemplary embodiment of the present invention will be described in detail with reference to the accompanying drawings.

First, a backlight unit according to an exemplary embodiment of the present invention will be described with reference to FIGS. 1 to 4.

Figure 2:
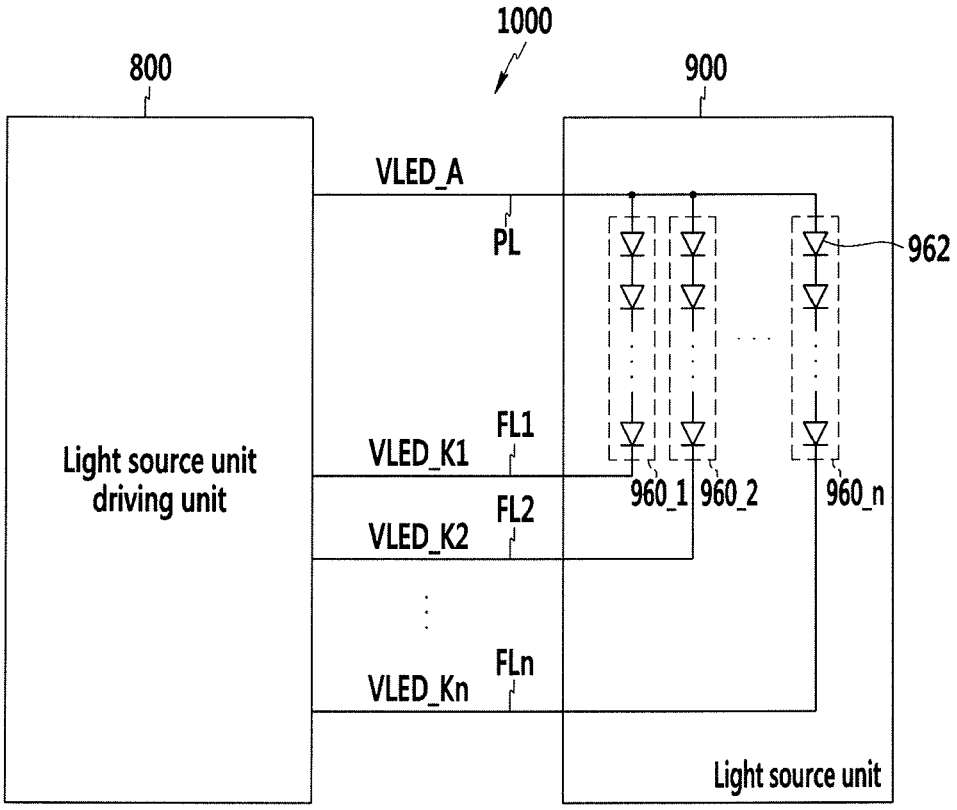
Figure 3:
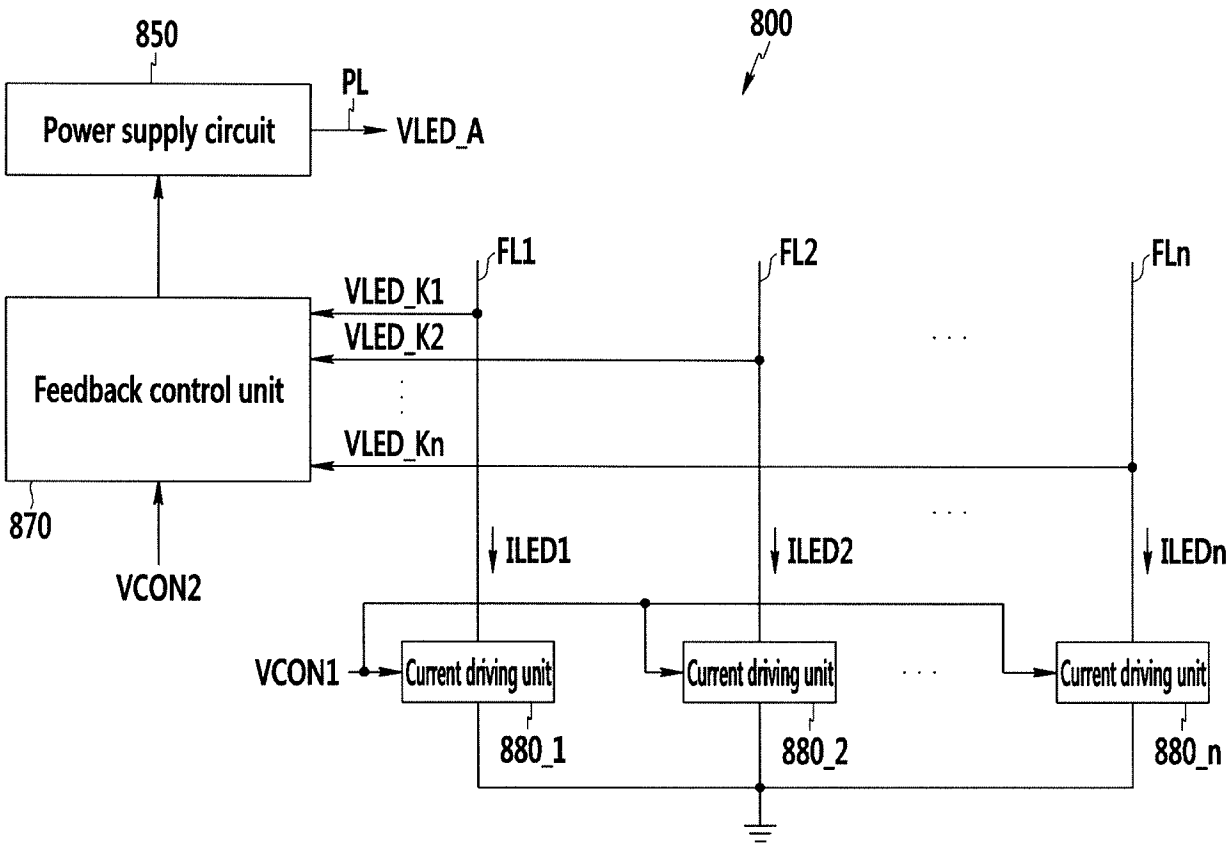
FIG. 3 is a block diagram of a light source driving unit according to an exemplary embodiment of the present invention.
Figure 4:
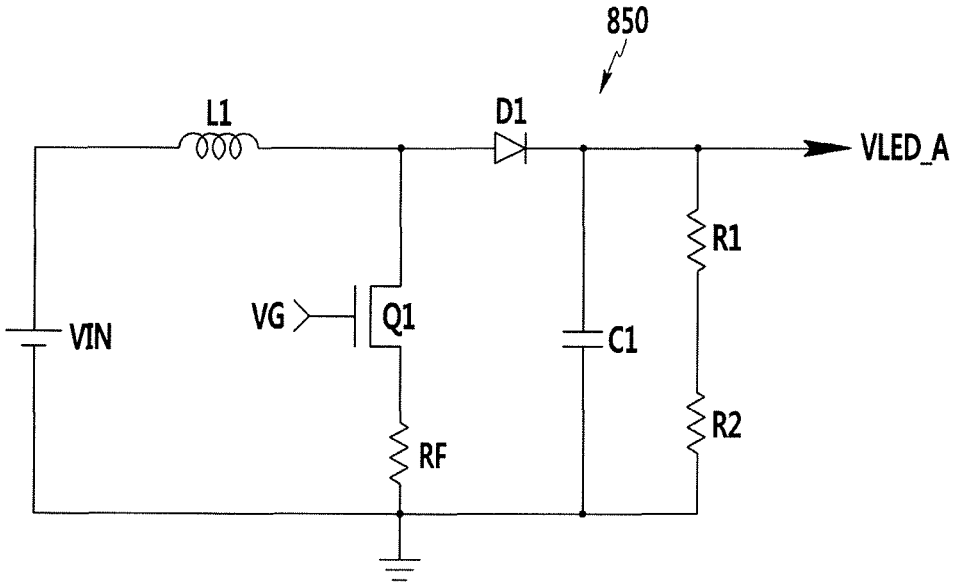
FIG. 4 is a circuit diagram of a power supply circuit which is included in the light source driving unit of FIG. 3 according to an exemplary embodiment of the present invention.

FIGS. 1 and 2 are block diagrams of a backlight unit according to an exemplary embodiment of the present invention. FIG. 3 is a block diagram of a light source driving unit according to an exemplary embodiment of the present invention. FIG. 4 is a circuit diagram of a power supply circuit which is included in the light source driving unit of FIG. 3 according to an exemplary embodiment of the present invention.

Referring to FIGS. 1 and 2, a backlight unit 1000 may include a light source driving unit 800 and a light source unit 900.

The light source unit 900 may irradiate a light to the outside and include at least one light source. The light source unit 900 may be classified into a direct type or an edge type depending on a location of the light source.

The light source unit 900 may include a plurality of LED strings 960_1 to **960_*n* (n is a natural number). However, the light source unit 900 may be one LED string. The LED strings 960_1 to 960_*n* may be connected to each other in parallel. Each of the LED strings 960_1 to 960_*n* may include a plurality of LEDs 962 which is connected to each other in series. Each of the LED strings 960_1 to 960_*n* may emit a light in response to a driving current. The driving current may be determined by a difference in voltage between an anode terminal and a cathode terminal of each LED 962 of the LED strings 960_1 to 960_*n***.

The cathode terminals of the LED strings 960_1 to **960_*n* are connected to the light source driving unit 800. Voltage signals at the cathode terminals of the LED strings 960_1 to 960_*n* may be transmitted to the light source driving unit 800 as feedback voltages VLED_K1 to VLED_Kn. The anode terminals of the LED strings 960_1 to 960_*n* may be electrically connected to each other. A power voltage VLED_A generated from the light source driving unit 800 may be applied to the anode terminals through a power transmitting wire PL. The light source driving unit 800 may generate the power voltage VLED_A for the LED strings 960_1 to 960_*n* and control driving currents ILED1 to ILEDn which flow in the LED strings 960_1 to 960_*n*. The light source driving unit 800 may be disposed on a circuit board 810 connected to the light source unit 900**.

The power transmitting wire PL may be formed on a circuit layer 820 (e.g., a flexible printed circuit layer). The power transmitting wire PL may connect the LED strings 960_1 to **960_*n* to the light source driving unit 800. Feedback lines FL1 to FLn may be further disposed on the circuit layer 820. The feedback lines FL1 to FLn may be separated from the power transmitting wire PL and transmit the feedback voltages VLED_K1 to VLED_Kn to the power supply circuit 850**.

Referring to FIG. 3, the light source driving unit 800 may include a power supply circuit 850, a feedback control unit 870, and a plurality of current driving units 880_1 to **880_*n***.

The current driving units 880_1 to **880_*n* may control the driving currents ILED1 to ILEDn flowing in the LED strings 960_1 to 960_*n* in response to a first control signal VCON1. The first control signal VCON1 may include LED current information. The LED current information may be a target signal which controls brightness of the LED strings 960_1 to 960_*n*. The LED current information may be supplied from an inside or an outside of the light source driving unit 800**.

The current driving units 880_1 to **880_*n* may include electric elements such as at least one transistor, an amplifier, a resistor, or the like. The electric elements are connected to the cathode terminals of the LED strings 960_1 to 960_*n*. FIG. 3 illustrates each of the LED strings 960_1 to 960_*n* may be connected to each of the current driving units 880_1 to 880_*n*. However an embodiment of the present invention is not limited thereto. For example, a plurality of LED strings 960_1 to 960_*n* may be connected to one of the current driving units 880_1 to 880_*n***.

The feedback control unit 870 may control the power supply circuit 850 based on the feedback voltages VLED_K1 to VLED_Kn and a second control signal VCON2. The feedback voltages VLED_K1 to VLED_Kn may be provided from the cathode terminals of the LED strings 960_1 to **960_*n*. The second control signal VCON2 may include the LED current information. The control signal output from the feedback control unit 870 to the power supply circuit 850 may be changed depending on the driving currents ILED1** to ILEDn.

The power supply circuit 850 may generate the power voltage VLED_A based on the control signal from the feedback control unit 870 and transmit the power voltage VLED_A to the anode terminal of the LED strings 960_1 to **960_*n* of the light source unit 900**.

Referring to FIG. 4, the power supply circuit 850 may be a boost converter which converts a low level of a DC voltage VIN into a high level of a DC voltage. The converted high level of the DC voltage may be used as the power voltage VLED_A.

The power supply circuit 850 may include an inductor L1, a diode D1, a switching element Q1, a capacitor C1, and at least one resistor RF, R1, or R2. The power voltage VLED_A of the power supply circuit 850 may be generated from magnetic energy of the inductor L1 and charging energy of the capacitor C1. The magnetic energy of the inductor L1 and the charging energy of the capacitor C1 may be generated according to an operation of turning on/off of the switching element Q1. The switching element Q1 may be a metal-oxide-semiconductor field-effect transistor (MOSFET). Hereafter, an inductor and an inductance of the inductor are represented by the same symbol for simplicity.

An operation of the power supply circuit 850 may be described with reference to FIG. 4.

First, when a gate control signal VG according to a third control signal VCON3 becomes a high level, the switching element Q1 may be turned on, and thus a current may flow through the inductor L1, the switching element Q1, and the resistor RF. At this time, the inductor L1 may convert electrical energy into magnetic energy corresponding to a level of the current, and store the converted magnetic energy. Therefore, as a high level period of the gate control signal VG gets longer, the magnetic energy stored in the inductor L1 may be increased.

Next, when the gate control signal VG becomes a low level, the switching element Q1 may be turned off, and the magnetic energy stored in the inductor L1 during the turn on period of the switching element Q1 may be converted into the electrical energy. The inductor L1 may generate a current by an electromotive force and the current may flow through the diode D1 and the resistors R1 and R2. A level of the current generated by the electromotive force may be determined by an amount of the stored magnetic energy.

The power voltage VLED_A may be generated across the serially connected resistors R1 and R2 by the electromotive force of the inductor L1 and the input voltage VIN, at the same time the capacitor C1 connected in parallel with the resistors R1 and R2 may be charged. As an amount of the magnetic energy stored in the inductor L1 is increased, the electromotive force of the inductor L1 may also be increased, and thus, a level of the power voltage VLED_A may be further boosted.

Next, when the gate control signal VG becomes a high level again, the current may flow through the switching element Q1 and the resistor RF again, and the inductor L1 may store the magnetic energy again. At this time, the level of the power voltage VLED_A may be maintained by the voltage stored in the capacitor C1.

As such, when a duty cycle of the gate control signal VG is increased, an intensity of the electromotive force of the inductor L1 may be increased, and thus the level of the power voltage VLED_A may be increased. When a duty cycle of the gate control signal VG is decreased, an intensity of the electromotive force of the inductor L1 may be decreased, and thus, the level of the power voltage VLED_A may be decreased.

The power supply circuit 850 illustrated in FIG. 4 is illustrative only, and an exemplary embodiment of the present invention is not limited thereto.

The power supply circuit 850, the feedback control unit 870, and the plurality of current driving units 880_1 to **880_*n*** may be included in one integrated circuit chip.

Figure 5:
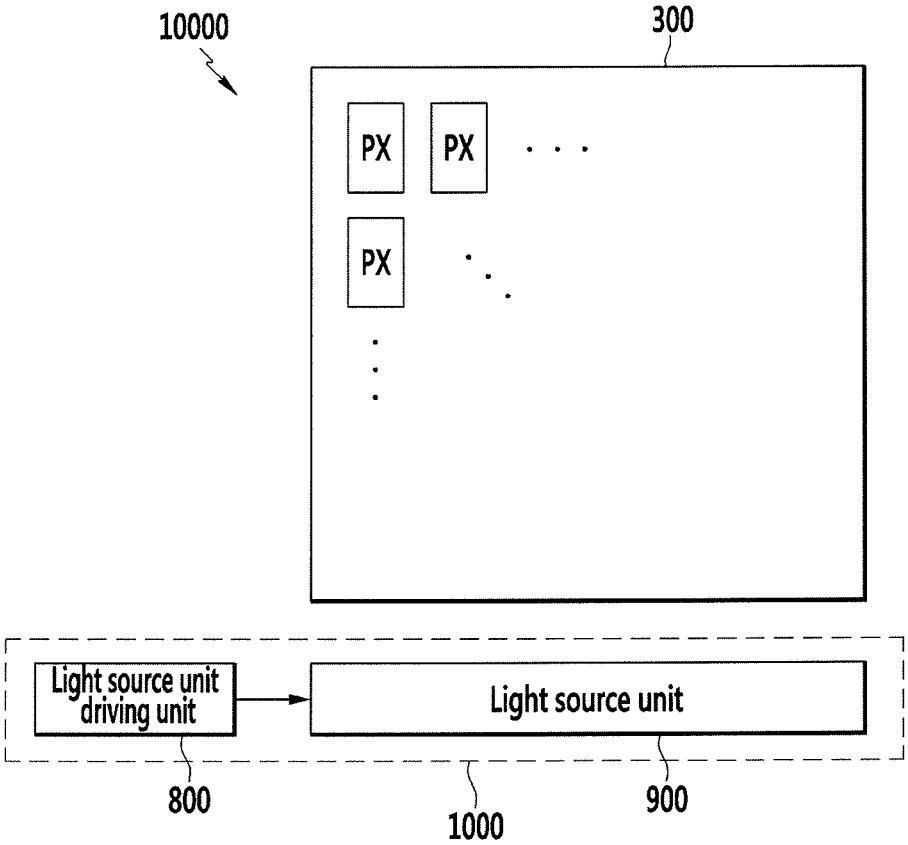
FIG. 5 is a block diagram of a display device including the backlight unit of FIG. 1 according to an exemplary embodiment of the present invention.
Figure 6:
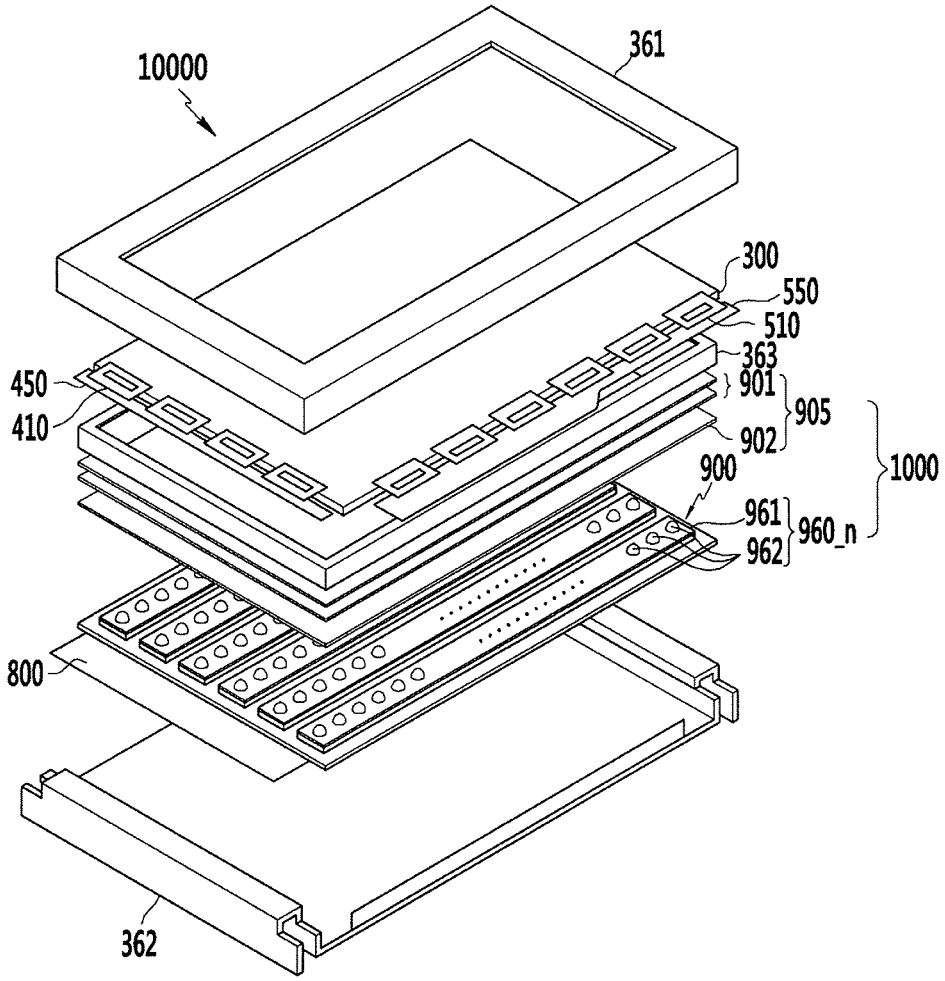
FIG. 6 is an exploded perspective view of the display device including the backlight unit of FIG. 1 according to an exemplary embodiment of the present invention.

The backlight unit 1000 according to an exemplary embodiment of the present invention may be included in various types of light receiving type display devices. FIGS. 5 and 6 illustrate an example of a light receiving type display device.

FIG. 5 is a block diagram of a light receiving type display device 10000 including the backlight unit 1000 according to an exemplary embodiment of the present invention. FIG. 6 is an exploded perspective view of a display device including the backlight unit according to an exemplary embodiment of the present invention.

Referring to FIG. 5, the light receiving type display device 10000 according to an exemplary embodiment of the present invention may include a display panel 300 and the backlight unit 1000. The display panel 300 may include a plurality of pixels PXs which is a unit for displaying an image. The backlight unit 1000 may include the light source unit 900 and the light source driving unit 800 according to an exemplary embodiment of the present invention as described above.

As an example of the light receiving type display device 10000, a LCD will be described in detail with reference to FIG. 6 along with FIG. 5. However, the light receiving type display device 10000 of the present invention is not limited thereto.

The liquid crystal display according to an exemplary embodiment of the present invention may include the display panel 300, the backlight unit 1000, an upper chassis 361, a lower chassis 362, and a mold frame 363. The mold frame 363 may store the display panel 300 and the backlight unit 1000.

The display panel 300 may include a lower panel and an upper panel which face each other, and further include a liquid crystal layer interposed between the lower panel and the upper panel. The lower panel may include a plurality of signal lines connected to the pixels PXs. Each pixel PX may include a switching element connected to the signal line and a liquid crystal capacitor connected to the switching element. The switching element may include at least one thin film transistor, and it may be provided in the lower panel.

The display panel 300 may be attached with a gate driving unit 410 and a data driving unit 510 in a tape carrier package (TCP) form as illustrated in FIG. 6, and the gate driving unit 410 and the data driving unit 510 may each be connected to printed circuit boards (PCBs) 450 and 550. The gate driving unit 410 and the data driving unit 510 may be mounted on the TCPs in a form of an integrated circuit chip. The TCPs may be attached to different edges of the lower panel of the display panel 300. The gate driving unit 410 and the data driver 510 may be connected to the signal lines of the display panel 300 through wires formed on the TCP. However, a form of the gate driving unit 410 and the data driver 510 is not limited to the form illustrated in FIG. 6. For example, the gate driving unit 410 and the data driver 510 may be integrated on the display panel 300 along with a thin film transistor, or may also be directly mounted on the display panel 300 as a form of one integrated circuit chip.

The backlight unit 1000 may include the light source unit 900 and an optical mechanism 905.

The light source unit 900 may be disposed under the display panel 300. The light source unit 900 may be connected to the light source driving unit 800 which supplies a driving voltage (e.g., power voltage VLED_A) to the light source unit 900.

The light source unit 900 may include at least one printed circuit board (PCB) 961 on which a plurality of LEDs 962 is mounted.

The optical instrument 905 may be disposed between the display panel 300 and the light source unit 900, and process the light received from the light source unit 900. The optical mechanism 905 may include a diffuser 902 and at least one optical sheet 901. The diffuser 902 may guide and diffuse the light received from the light source unit 900 toward the display panel 300.

The backlight unit 1000 may be stored and fixed in the lower chassis 362. The lower chassis 362 may be fixed to the mold frame 363. The lower chassis 362 may be connected to a ground voltage GND.

Next, the power transmitting wire PL of the backlight unit according to an exemplary embodiment of the present invention will be described with reference to FIGS. 7 to 9, along with the above-mentioned drawings.

Figure 7:
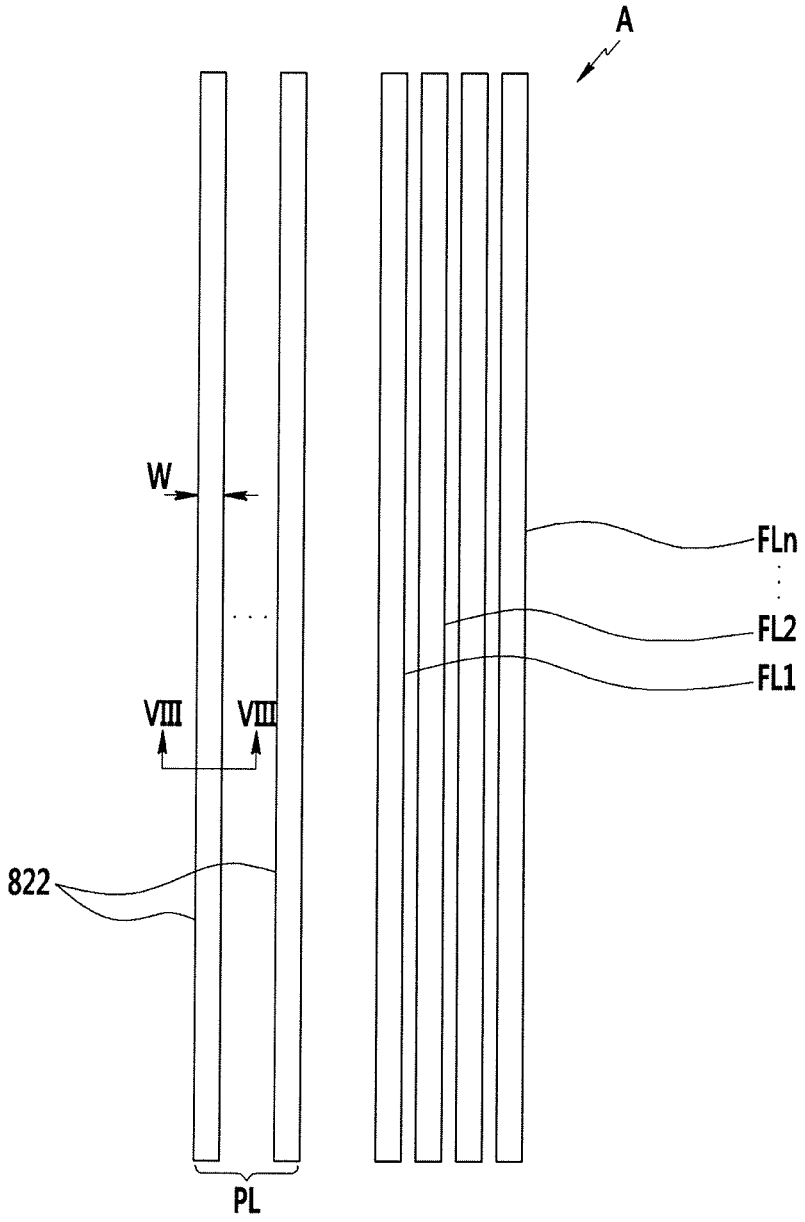
FIG. 7 is a plan view illustrating a wire unit which connects a light source driving unit to a light source unit, according to an exemplary embodiment of the present invention.

FIG. 7 is a plan view illustrating a wire unit which connects the light source driving unit according to an exemplary embodiment of the present invention to a light source unit. FIG. 7 is an enlarged view of portion A of FIG. 1. FIG. 8 is a cross-sectional view of the wire unit of FIG. 7 taken along line VIII-VIII. FIG. 9 is an equivalent circuit diagram of a power transmitting wire according to an exemplary embodiment of the present invention.

Figure 8:
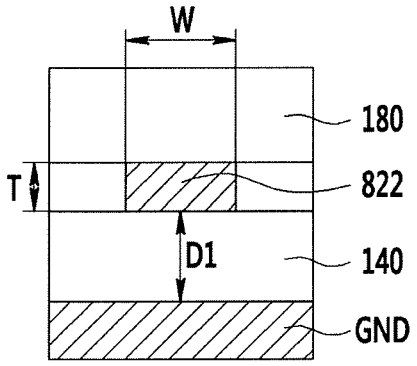
FIG. 8 is a cross-sectional view of the wire unit of FIG. 7 taken along line VIII-VIII.

Referring to FIGS. 7 and 8, the wire unit of the circuit layer 820 may include the power transmitting wire PL. The circuit layer 820 may include a flexible printed circuit layer.

The power transmitting wire PL according to an exemplary embodiment of the present invention may include at least two circuit patterns 822. The at least two circuit patterns 822 may extend in parallel with each other, and each of the at least two circuit patterns 822 may extend in a straight form, but the shape thereof is not limited thereto.

Referring to FIG. 8, a lower portion and an upper portion of the circuit pattern 822 of the power transmitting wire PL may be provided with insulating layers 140 and 180, respectively. The circuit pattern 822 of the power transmitting wire PL and the ground voltage GND terminal may form a capacitor, and the insulating layer 140 disposed between the circuit pattern 822 and the ground voltage GND terminal acts as a dielectric layer of the capacitor. The ground voltage GND terminal of the capacitor may be at least one of the lower chassis 362 and the feedback lines FL1 to FLn which are included in the display device.

A width W of each of the at least two circuit patterns 822 of the power transmitting wire PL according to an exemplary embodiment of the present invention may range from about 0.2 mm to about 0.35 mm. A resistance of the entire circuit pattern 822 included in the power transmitting wire PL may be equal to or more than 1 ohm. The resistance of the power transmitting wire PL may be set to be equal to more than about 1 ohm by controlling a thickness T of each circuit pattern 822. The circuit pattern 822 may include a conductive material such as copper (Cu).

Figure 9:
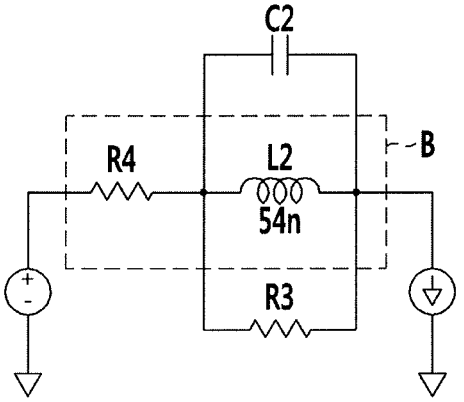
FIG. 9 is an equivalent circuit diagram of a power transmitting wire according to an exemplary embodiment of the present invention.
Figure 10:
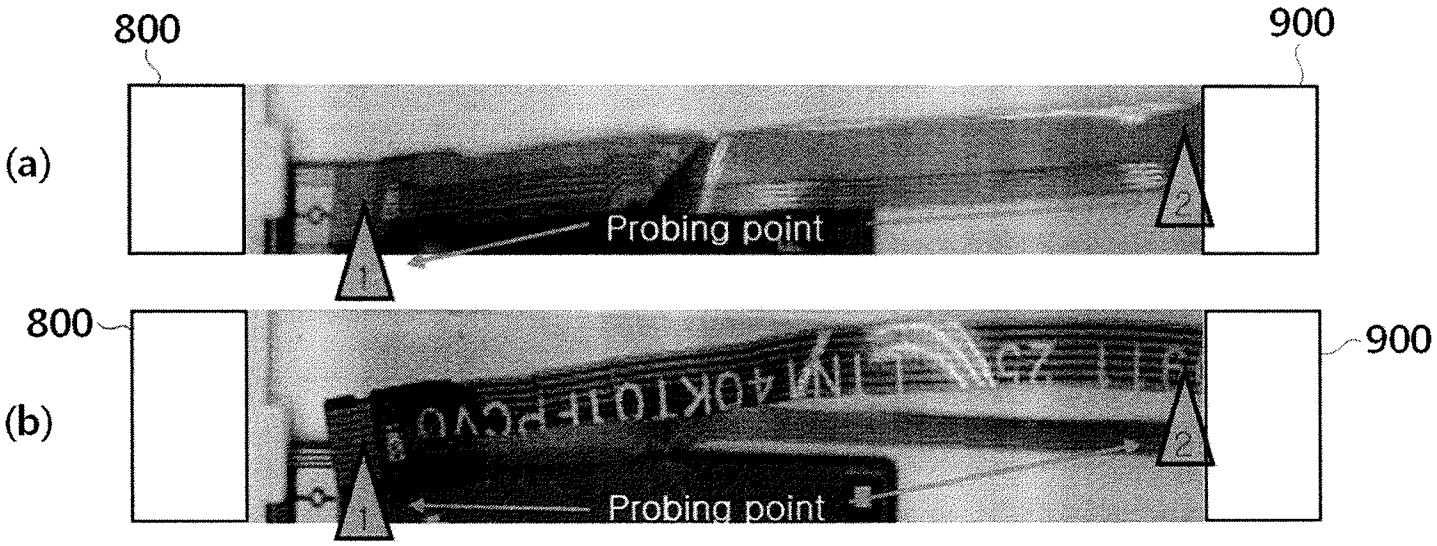
FIGS. 10A and 10B are photographs illustrating positions of measuring signals measured at the power transmitting wires according to a related art and an exemplary embodiment of the present invention, respectively.

An impedance of each of the circuit patterns 822 in the power transmitting wire PL may be increased by limiting the width W of each of the circuit patterns 822, and thus, the circuit patterns 822 of the power transmitting wire PL may serve as a ferrite bead as illustrated in FIG. 9. The circuit patterns 822 of the power transmitting wire PL according to an exemplary embodiment of the present invention may configure a resistor R4 and an inductor L2 coupled in series as illustrated in FIG. 9, and accordingly, serve as the ferrite bead.

The ferrite bead formed by the circuit pattern 822 in the power transmitting wire PL may serve as a filter blocking a high frequency electro-magnetic noise, and thus, it may minimize an electro-magnetic interference (EMI) of a high frequency band. For example, the high frequency electro-magnetic noise may be transferred or radiated through the power transmitting wire PL when the switching element Q1 of the power supply circuit 850 is turned on/off. The power transmitting wire PL according to an exemplary embodiment of the present invention may serve as a general conducting wire in a low frequency band, but it may have a high impedance in a specific high frequency band, and serve as the inductor L2.

The resistor R4 and the inductance L2 of the ferrite bead may be appropriately controlled to meet the frequency band to be blocked. According to an exemplary embodiment of the present invention, the power transmitting wire PL may be formed to include at least two circuit patterns 822. The width W of each of the circuit patterns 822 may be limited into a predetermined range as described above so that the resistor R4 and the inductance L2 may be controlled to block the electro-magnetic noise of a specific frequency band.

For example, according to an exemplary embodiment of the present invention, the width W of each of the at least two circuit patterns 822 in the power transmitting wire PL may be set to range from about 0.2 mm to about 0.35 mm. The resistance of the power transmitting wire PL may be set to be equal to or more than about 1 ohm. Accordingly, the impedance of the resistor R4 and the inductance L2 may be increased and the electro-magnetic interference in a wireless wide area network (WWAN) band may be minimized. The WWAN band may range from 700 MHz to 5 GHz.

A capacitor C2 may be connected to a resistor R3 and the inductor L2 in parallel as illustrated in FIG. 9. The capacitor C2 and the resistor R3 may be omitted since they are a parasitic capacitor and a parasitic resistor, respectively.

To form the filter for blocking the high frequency electro-magnetic noise of the WWAN band on the power transmitting wire PL, the circuit layer 820 at a portion at which the power transmitting wire PL is formed may be a single layer.

Referring back to FIG. 7, the wire unit of the circuit layer 820 may further include the feedback lines FL1 to FLn which transmit the feedback voltages VLED_K1 to VLED_Kn into the light source driving unit 800. The feedback voltages VLED_K1 to VLED_Kn may be received from each of the LED strings 960_1 to **960_*n* of the light source unit 900. The number of feedback lines FL1 to FLn may be equal to the number of LED strings 960_1 to 960_*n* of the light source unit 900**.

Next, a blocking efficiency for the electro-magnetic noise by the power transmitting wire according to an exemplary embodiment of the present invention will be described with reference to FIGS. 10 to 13.

Figure 11:
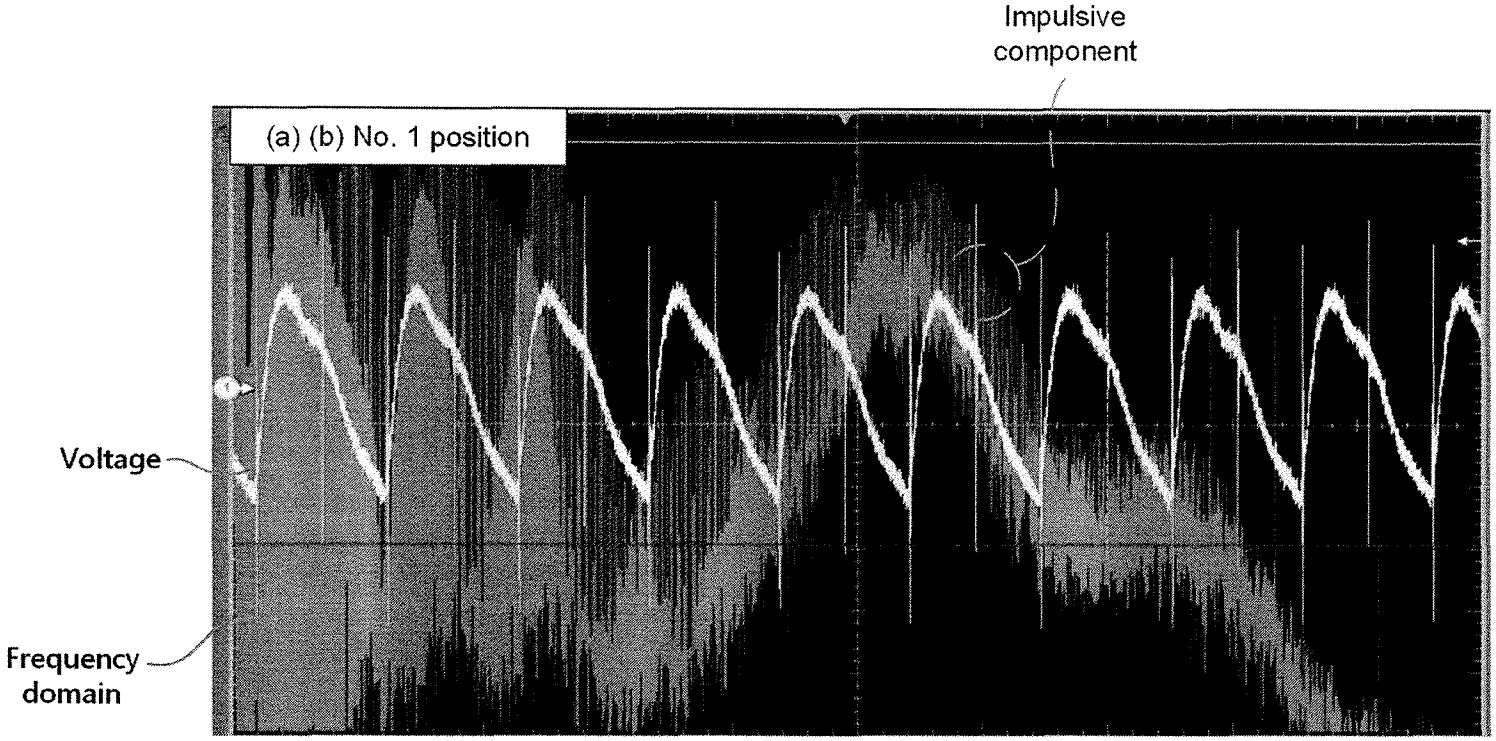
FIG. 11 is a waveform diagram illustrating a signal measured at position No. 1 illustrated in FIGS. 10A and 10B.
Figure 12:
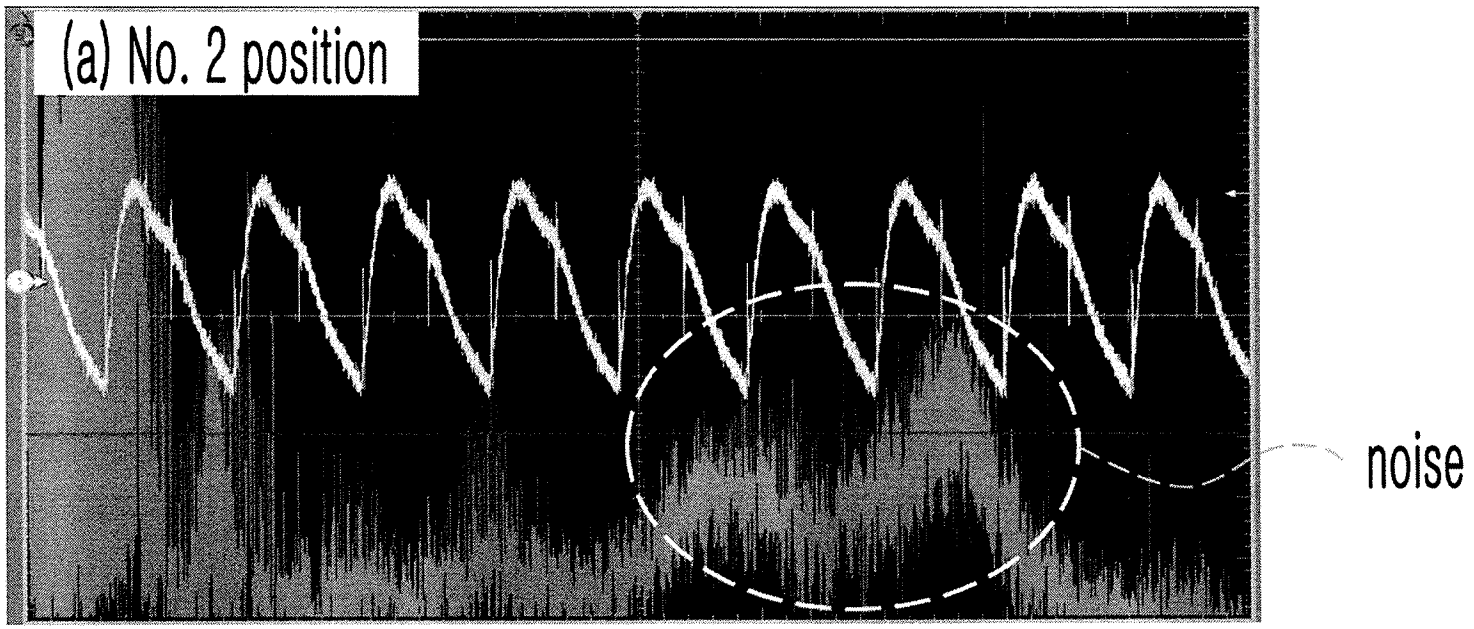
FIGS. 12 and 13 are waveform diagrams illustrating signals measured at position No. 2 of the power transmitting wires according to the related art and the exemplary embodiment of the present invention of FIGS. 10A and 10B, respectively.
Figure 13:
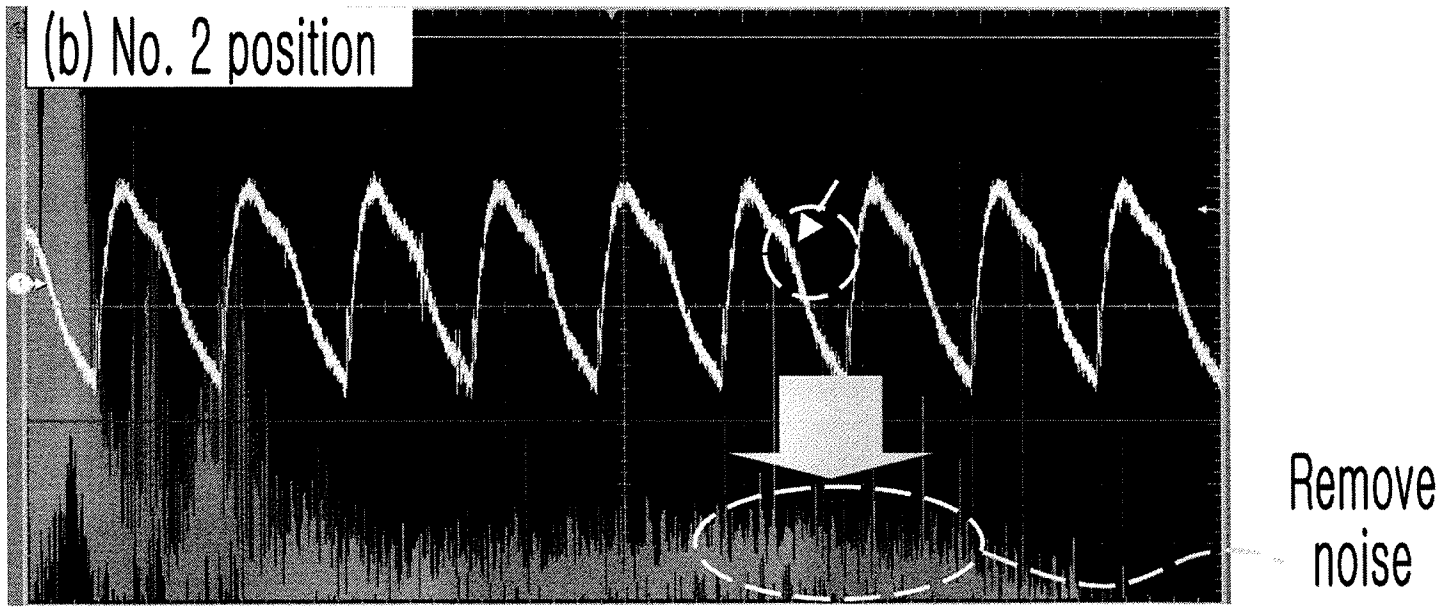

FIGS. 10A and 10B are photographs illustrating positions of signals measured at power transmitting wires according to a related art and an exemplary embodiment of the present invention, respectively. FIG. 11 is a waveform diagram illustrating a signal measured at No. 1 position illustrated in FIGS. 10A and 10B. FIGS. 12 and 13 are waveforms diagrams illustrating signals measured at No. 2 position of the power transmitting wires according to the related art and the exemplary embodiment of the present invention of FIGS. 10A and 10B, respectively.

Referring to FIG. 10A, the voltage waveforms of the No. 1 position and the No. 2 position of the power transmitting wire according to the related art may be measured.

Referring to FIG. 10B, the voltage signals of the No. 1 position and the No. 2 position of the power transmitting wire PL according to the exemplary embodiment of the present invention may be measured. The No. 1 position and No. 2 position may be adjacent to the light source driving unit 800 and the light source unit 900, respectively. The power transmitting wire according to the related art may be formed in a single circuit pattern to lower its resistance. The power transmitting wire PL according to the exemplary embodiment of the present invention may be formed in a relatively large width of about 3 mm.

Referring to FIG. 11, as illustrated in FIGS. 10A and 10B, the voltage waveform measured at the No. 1 position may include a periodic impulsive component and a high level of noise over the entire frequency band.

Referring to FIG. 12, the voltage waveform measured at the No. 2 position of FIG. 10A according to the related art may include the periodic impulsive component observed in FIG. 11 (e.g., the waveform measured at the No. 1 position), and the voltage waveform may further include the high electromagnetic noise in a high frequency, as indicated by a dotted circle. The high frequency band may be a WWAN band. Referring to FIG. 13, the voltage waveform measured at No. 2 position of FIG. 10B according to the exemplary embodiment of the present invention may not include the periodic impulsive component observed in FIG. 11 (i.e., the waveform measured at No. 1 position), and the high electromagnetic noise in the high frequency may be reduced, as indicated by a dotted circle and an arrow.

Next, a blocking efficiency for the electromagnetic noise depending on the number of circuit patterns 822 included in a power transmitting wire PL according to an exemplary embodiment of the present invention will be described with reference to FIGS. 14 to 18.

FIGS. 14 to 18 are graphs illustrating a level of electromagnetic noise depending on the number of circuit patterns 822 in the power transmitting wire PL according to an exemplary embodiment of the present invention.

Referring to FIGS. 14 to 18, a label Ga represents a reference noise level Ga which is a general electromagnetic noise level; a label Gb represents an electromagnetic noise level Gb which is radiated from the power transmitting wire PL; and a label Gc represents an electromagnetic noise level Gc at a lowest level. In FIGS. 14 to 18, the reference noise level Ga and the electromagnetic noise level Gc at the lowest level are indicated to be the same for comparison with a level of the electromagnetic noise depending on the number of circuit patterns 822 of the power transmitting wire PL.

Figure 14:
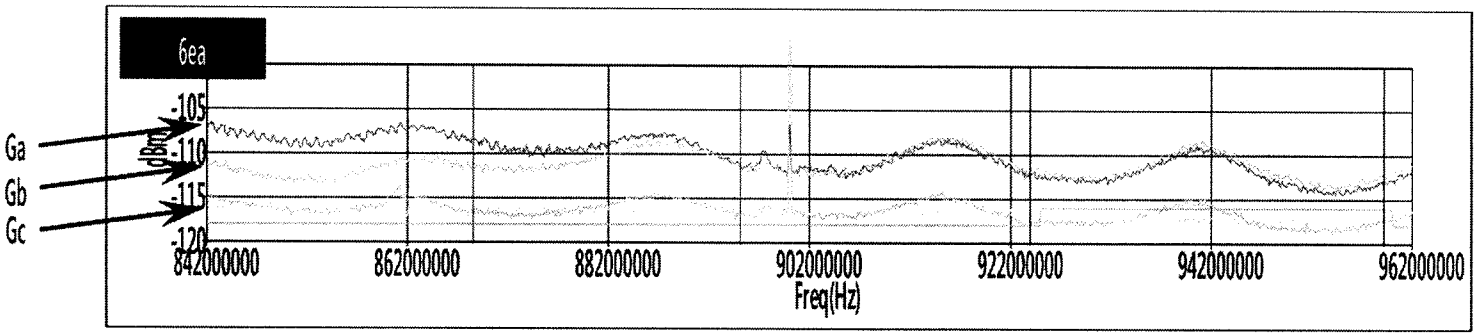
FIGS. 14 to 18 each are graphs illustrating a level of electro-magnetic noise depending on the number of circuit patterns of power transmitting wire according to an exemplary embodiment of the present invention.
Figure 15:
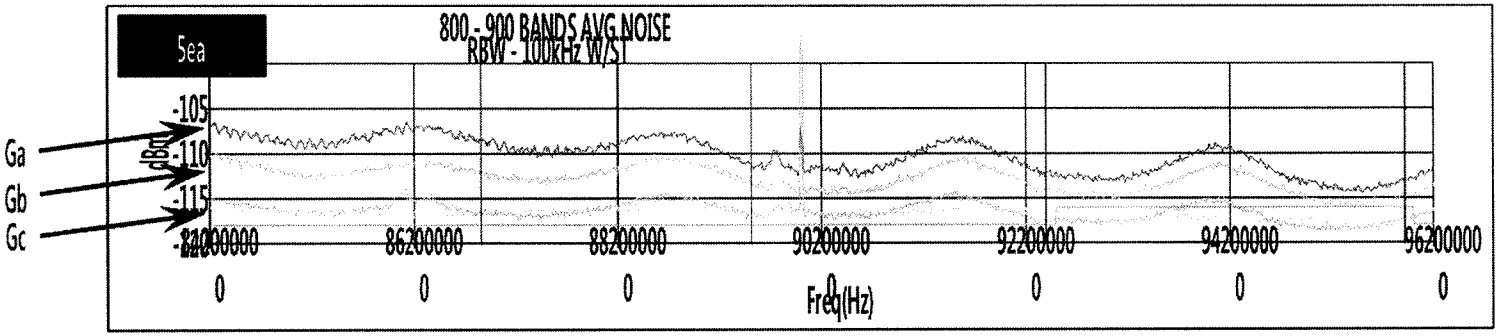
Figure 16:
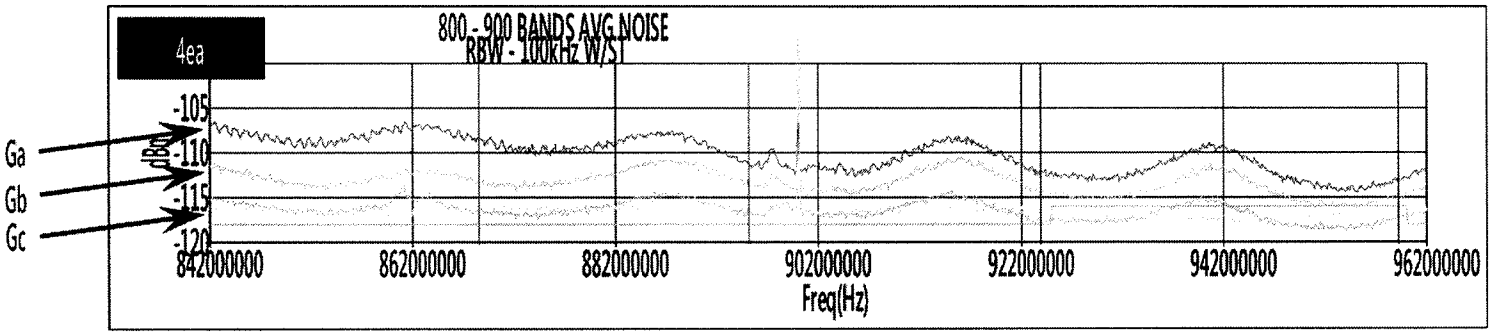
Figure 17:
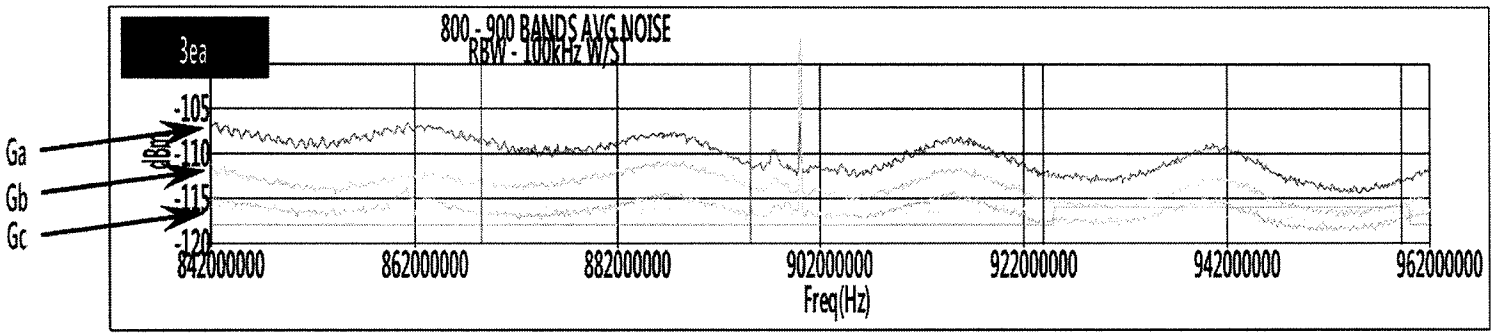
Figure 18:
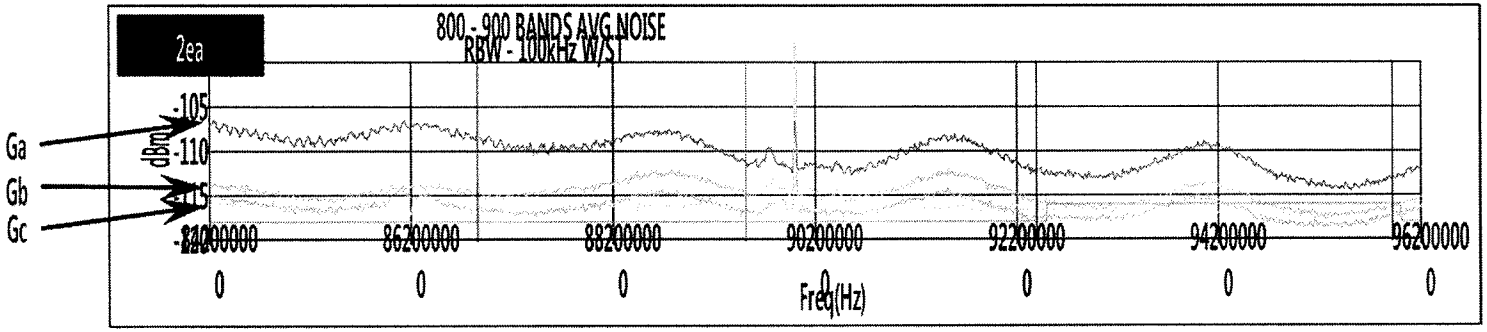

FIG. 14 illustrates the electromagnetic noise level measured when the number of circuit patterns 822 is six. FIG. 15 illustrates the electromagnetic noise level measured when the number of circuit patterns 822 is five. FIG. 16 illustrates the electromagnetic noise level measured when the number of circuit patterns 822 is four. FIG. 17 illustrates the electromagnetic noise level measured when the number of circuit patterns 822 is three. FIG. 18 illustrates the electromagnetic noise level measured when the number of circuit patterns 822 is is two.

Referring to FIGS. 14 to 18, as the number of circuit patterns 822 is reduced, the electro-magnetic noise of 800 MHz to 900 MHz band may be reduced. In other words, as the number of circuit patterns 822 is reduced, the resistance and the inductance of the power transmitting wire PL may be increased so that high frequency electromagnetic noise generated from the light source driving unit 800 may be better blocked.

Next, a blocking efficiency of a low pass filter by the circuit layer 820 according to an exemplary embodiment of the present invention will be described with reference to FIGS. 19 to 22.

Figure 19:
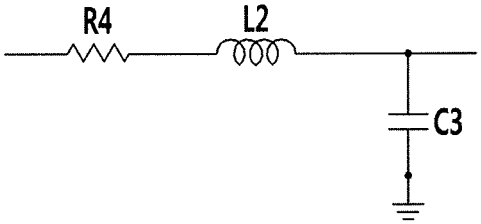
FIG. 19 is an equivalent circuit diagram of a power transmitting wire according to an exemplary embodiment of the present invention.
Figure 20:
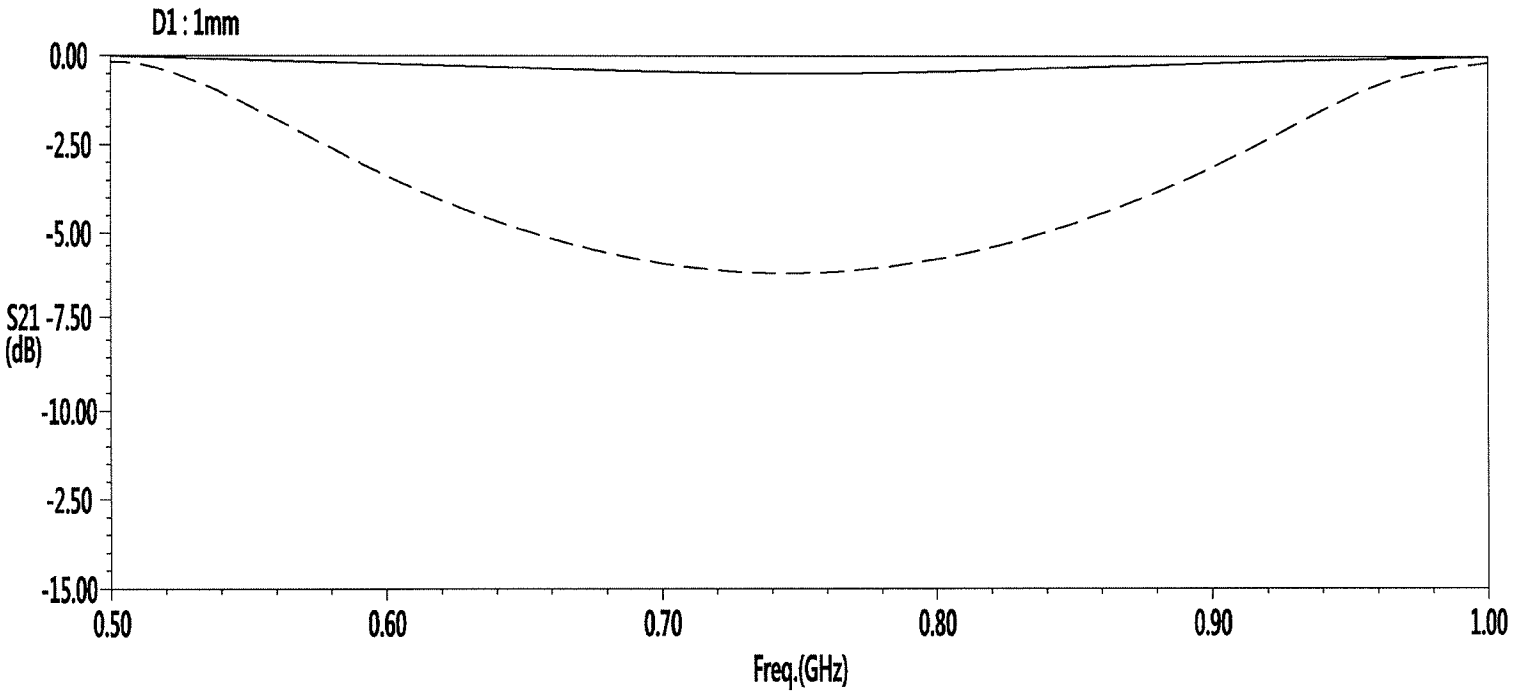
FIGS. 20 to 22 are graphs illustrating an insertion loss of a power signal depending on a thickness of a lower insulating layer of the wire unit illustrated in FIG. 8.
Figure 21:
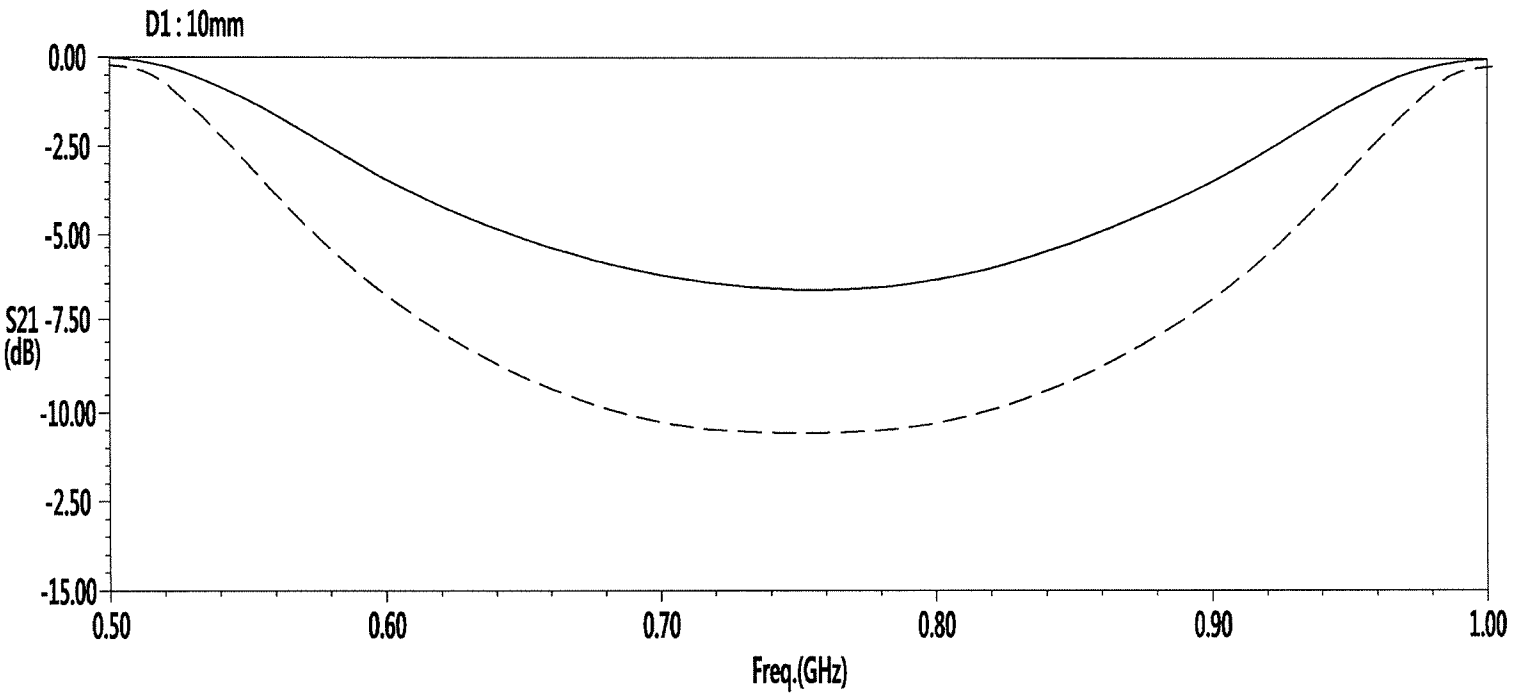
Figure 22:
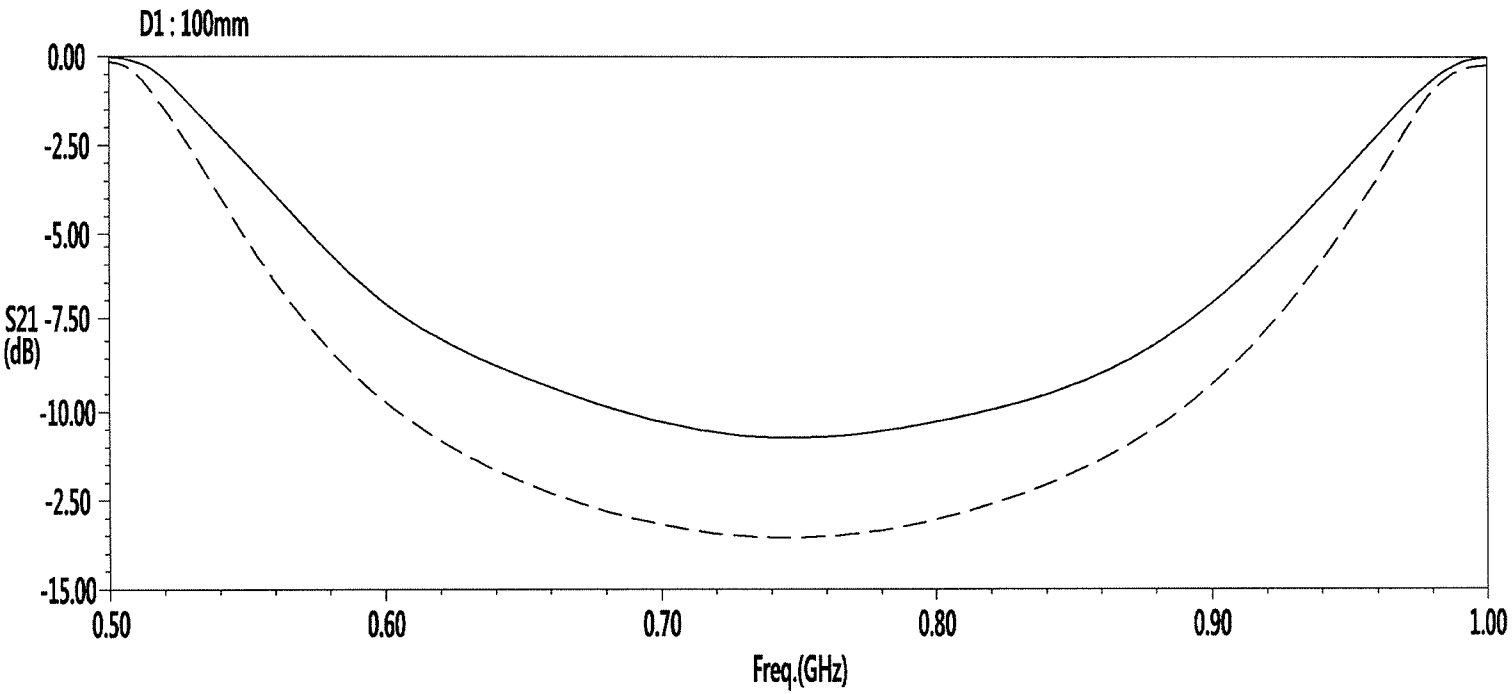

FIG. 19 is an equivalent circuit diagram of a power transmitting wire PL according to an exemplary embodiment of the present invention. FIGS. 20 to 22 are graphs illustrating an insertion loss of a power signal depending on a thickness of a lower insulating layer of the wire unit illustrated in FIG. 8.

The circuit pattern 822 of the power transmitting wire PL according to an exemplary embodiment of the present invention may form a capacitor by overlapping elements such as the lower chassis 362 or the feedback lines FL1 to FLn, having the insulating layer 140 interposed between the capacitor and the elements, as illustrated in FIG. 8 described above. Therefore, as illustrated in FIG. 19, the power transmitting wire PL configuring the resistor R4 and the inductor L2 may form the ground voltage GND and a capacitor C3, and thus, the low pass filter may formed and the electromagnetic noise of the high frequency band may be more effectively blocked.

The blocking efficiency for the electromagnetic noise by the low pass filter formed by the circuit pattern 822 may be increased as the width W of the circuit pattern 822 is reduced. This is because the inductance L2 may be increased as the width W of the circuit pattern 822 is reduced, as illustrated in FIG. 19.

Further, as the thickness D1 of the insulating layer 140 is increased, an intensity of the magnetic field generated by the inductor L2 is increased, and thus, the blocking efficiency by the low pass filter for the electro-magnetic noise of the high frequency may also be increased.

FIG. 20 illustrates an insertion loss (S21) when the thickness D1 of the insulating layer 140 is about 1 mm. FIG. 21 illustrates an insertion loss when the thickness D1 of the insulating layer 140 is about 10 mm. FIG. 22 illustrates an insertion loss (S21) when the thickness D1 of the insulating layer 140 is about 100 mm.

Referring to FIGS. 20 to 22, as the thickness D1 of the insulating layer 140 is increased, the blocking efficiency for the electro-magnetic noise may be increased in a frequency band of about 700 MHz to about 900 MHz. Thus, the WWAN band may be blocked from passing through the power transmitting wire PL.

Figure 23:
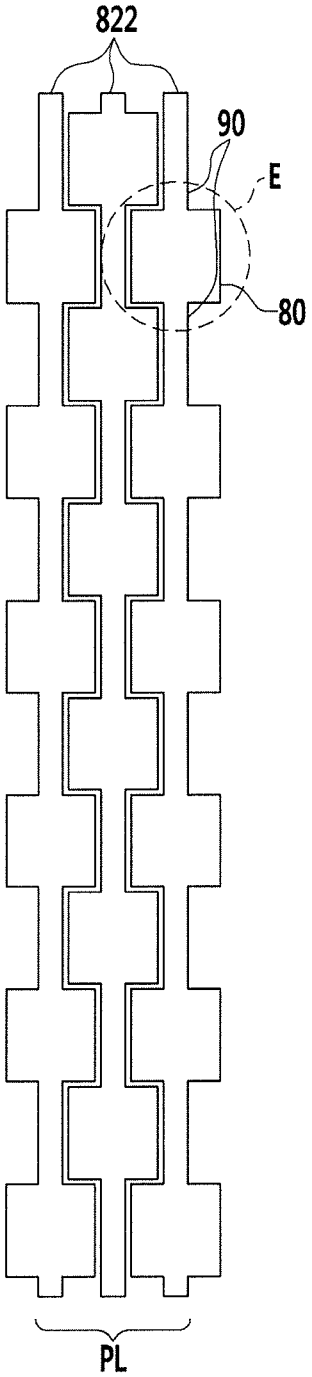
FIG. 23 is a plan view illustrating a wire unit which connects a light source driving unit to a light source unit, according to an exemplary embodiment of the present invention.
Figure 24:
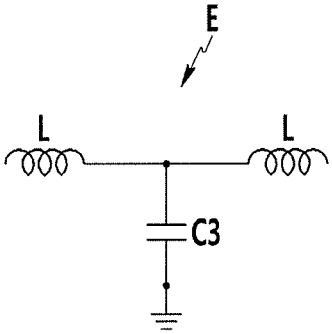
FIG. 24 is an equivalent circuit diagram of a part of the wire unit of FIG. 23, according to an exemplary embodiment of the present invention.

FIG. 23 is a plan view illustrating a wire unit which connects a light source driving unit according to an exemplary embodiment of the present invention to a light source unit. FIG. 24 is an equivalent circuit diagram of a part of the wire unit of FIG. 23.

As described above, a blocking band for the electro-magnetic noise may be controlled by controlling a capacitance of the capacitor C3 of the low pass filter which is formed by the circuit pattern 822 of the power transmitting wire PL as described above.

The power transmitting wire PL may include a first circuit pattern, a second circuit pattern, and a third circuit pattern. The first circuit pattern may include a first extension having a first connection at a first side and a second connection at a second side. The second circuit pattern may include a second extension having a third connection at a third side and a fourth connection at a fourth side. The third circuit pattern may include a third extension and a fourth extension connected through a fifth connection. The fifth connection may be disposed between the first extension and the second extension.

To this end, each circuit pattern 822 of the power transmitting wire PL may include a plurality of unit circuit patterns E connected in a row to each other, as illustrated in FIG. 23.

Each unit circuit pattern E may include an extension 80 at a center thereof and a pair of connection parts 90 positioned at both sides of the extension 80. The pair of connection parts 90 may have a smaller width than that of the extension 80. Referring to FIG. 24 illustrating an equivalent circuit of the unit circuit pattern E, each unit circuit pattern E may form a capacitor C3 connected to the ground voltage GND and a pair of inductors L connected to the capacitor. The connection part 90 of the unit circuit pattern E may have a straight form.

The blocking band of the electro-magnetic noise may be controlled by controlling an area of the extension 80 of the unit circuit pattern E and a resistance of the connection part 90, and as a result, the electro-magnetic interference may be effectively reduced. The electro-magnetic noise, which is blocked, may be radiated or transferred from the power transmitting wire PL, and may be in a frequency band of WWAN.

An exemplary embodiment of the present invention provides a backlight unit including a power transmitting wire capable of reducing electro-magnetic noise from power transmitted through the power transmitting wire of the backlight unit to reduce an electro magnetic interference. The power transmitting wire may also be capable of minimizing electro magnetic noise of a WWAN band.

While this invention has been described particularly shown and described with reference to exemplary embodiments thereof, it will be understood by those of ordinary skill in the art that various changes in form and details may be made therein without departing from the spirit and scope of the inventive concept as defined by the following claims.

What is claimed is:

1. A backlight unit, comprising:

a light source unit including at least one light source;

a power supply circuit configured to supply a power voltage to the light source unit; and a power transmitting wire configured to transmit the power voltage, wherein the power transmitting wire includes at least two circuit patterns that form a ferrite bead, wherein a first circuit pattern of the at least two circuit patterns includes a first extension, a first connection disposed at a first side of the first extension and a second connection disposed at a second side of the first extension, wherein the first extension is wider than the first and second connections, wherein a second circuit pattern of the at least two circuit patterns includes a second extension, a third extension and a third connection therebetween, wherein the second and third extensions are wider than the third connection, wherein the third connection is disposed adjacent to the first extension, the second extension is disposed adjacent to the first connection and the third extension is disposed adjacent to the second connection.

2. The backlight unit of claim 1, wherein:

a width of each of the at least two circuit patterns is from about 0.2 mm to about 0.35 mm.

3. The backlight unit of claim 2, wherein:

a resistance of the power transmitting wire is about 1 ohm, or more.

4. The backlight of claim 2, further comprising:

a flexible circuit layer on which the power transmitting wire is formed.

5. The backlight unit of claim 4, wherein:

a portion of the flexible circuit layer is a single layer.

6. The backlight unit of claim 5, further comprising:

a capacitor formed by the power transmitting wire and a ground voltage terminal.

7. The backlight unit of claim 6, wherein:

the ground voltage terminal is connected with a chassis which stores the backlight unit.

8. The backlight unit of claim 7, wherein:

the power supply circuit includes a switching element and an inductor, wherein the inductor is connected to an input voltage terminal and the switching element is connected to the inductor, wherein the switching element is turned on and off according to a gate control signal.

9. The backlight unit of claim 4, further comprising:

a feedback line configured to transmit a feedback voltage to the power supply circuit, wherein the feedback line is formed on the flexible circuit layer.

10. The backlight unit of claim 1, wherein:

a resistance of the power transmitting wire is about 1 ohm, or more.

11. The backlight unit of claim 10, further comprising:

a flexible circuit layer on which the power transmitting wire is formed.

12. The backlight unit of claim 11, wherein:

a portion of the flexible circuit layer is a single layer.

13. The backlight unit of claim 1, further comprising:

a capacitor formed by the power transmitting wire and a ground voltage terminal.

14. The backlight unit of claim 13, wherein:

the ground voltage terminal is connected with a chassis which stores the backlight unit.

15. The backlight unit of claim 13, wherein:

the power supply circuit includes a switching element and an inductor, wherein the inductor is connected to an input voltage terminal and the switching element is connected to the inductor, wherein the switching element is turned on and off according to a gate control signal.

16. A backlight unit, comprising:

a light source unit including at least one light source;

a power supply circuit configured to supply a power voltage to the light source unit; and a power transmitting wire configured to transmit the power voltage, wherein the power transmitting wire includes at least two circuit patterns, wherein at least one of the at least two circuit patterns configures a resistor and an inductor coupled in series to form a ferrite bead, wherein each of the at least two circuit patterns includes first and second circuit patterns which are arranged in a row, wherein the first circuit pattern includes a first extension, a first connection disposed at a first side of the first extension and a second connection disposed at a second side of the first extension, wherein the first extension is wider than the first and second connection, wherein the second circuit pattern includes a second extension a third extension and third connection therebetween, wherein the second and third extensions are wider than the third connection, wherein the third connection is disposed adjacent to the first extension, the second extension is disposed adjacent to the first connection and the third extension is disposed adjacent to the second connection.

17. A backlight unit, comprising:

a light source unit including at least one light source;

a power supply circuit configured to supply a power voltage to the light source unit; and a power transmitting wire configured to transmit the power voltage, wherein the power transmitting wire includes a first circuit pattern, a second circuit pattern, and a third circuit pattern that are adjacent to each other, wherein the first circuit pattern includes a first extension, a first connection connected to a first side of the first extension, and a second connection connected to a second side of the first extension, a width of the first extension being wider than both the first connection and the second connection, wherein the second circuit pattern includes a second extension, a third connection connected to a third side of the second extension, and a fourth connection connected to a fourth side of the second extension, a width of the second extension being wider than both the third connection and the fourth connection, wherein the third circuit pattern includes a third extension, a fourth extension, and a fifth connection having a width less than both the third extension and the fourth extension, and connected between the third extension and the fourth extension, wherein the fifth connection is disposed between the first extension and the second extension.

* * * * *